United States Patent [19]

Brockmeyer

[11] 4,250,800

[45] Feb. 17, 1981

[54] OUTLET TUBE FOR AIR CONDITIONING SYSTEMS

[75] Inventor: Heinz P. Brockmeyer, Giessen, Fed. Rep. of Germany

[73] Assignee: Schmidt-Reuter Ingenieurgesellschaft mbH & Co. KG, Cologne, Fed. Rep. of Germany

[21] Appl. No.: 674,850

[22] Filed: Apr. 8, 1976

[30] Foreign Application Priority Data

Apr. 9, 1975 [DE] Fed. Rep. of Germany ..... 2515440
Dec. 1, 1975 [DE] Fed. Rep. of Germany ..... 2553984
Dec. 1, 1975 [DE] Fed. Rep. of Germany ... 7538262[U]

[51] Int. Cl.[3] ..... F24F 7/00; F24F 13/00

[52] U.S. Cl. ..... 98/40 C; 98/40 DL; 98/41 SV; 98/103; 98/DIG. 7; 285/354; 339/16 R

[58] Field of Search ..... 98/40 C, 40 L, 37, 41 R, 98/41 AV, 41 SV, DIG. 7, 101–104; 239/562, 563, 564; 285/331; 126/116 B; 339/15, 16 R, 16 RC, 16 C, 117 P, 117 R

[56] References Cited

U.S. PATENT DOCUMENTS

| | | | |
|---|---|---|---|
| 873,940 | 12/1907 | Hoffman | 339/16 R |
| 1,304,384 | 5/1919 | Schlatter | 239/564 |
| 1,363,383 | 12/1920 | Ash et al. | 98/103 |
| 1,645,140 | 10/1927 | Herbruck | 98/103 |
| 1,892,747 | 12/1934 | Kurth | 98/41 AV |
| 2,167,472 | 7/1939 | Bedford | 236/49 |
| 2,352,876 | 7/1944 | Wilson | 98/DIG. 7 |
| 2,452,941 | 11/1948 | Little | 98/DIG. 7 |
| 2,621,875 | 12/1952 | Darling | 339/16 R |
| 2,634,311 | 4/1953 | Darling | 339/16 R |
| 2,960,021 | 11/1960 | Cotts | 98/103 |
| 3,170,137 | 2/1965 | Brandt | 339/16 R |
| 3,447,161 | 6/1969 | Weikel | 339/16 R |
| 3,665,969 | 5/1972 | Clifford | 98/103 |
| 3,748,863 | 7/1973 | Pogonowski et al. | 285/331 |
| 3,893,719 | 7/1975 | Eidelberg et al. | 285/354 |
| 3,931,992 | 1/1976 | Coel | 285/354 |
| 3,935,898 | 2/1976 | Westergren | 98/40 DL |
| 3,972,578 | 8/1976 | Reynolds et al. | 339/15 |

FOREIGN PATENT DOCUMENTS

| | | | |
|---|---|---|---|
| 231123 | 5/1963 | Austria | 98/41 SV |
| 2407448 | 8/1975 | Fed. Rep. of Germany | 98/37 |

*Primary Examiner*—Henry C. Yuen
*Attorney, Agent, or Firm*—Gilbert L. Wells

[57] ABSTRACT

Air outlet tubes for air conditioning systems are subdivided into a plurality of tube portions which are provided with corresponding positive and negative coupling elements at either end. The tube portions are of different form and length so that complete air outlets may be assembled which suit the particular requirements of each working place, desk etc. to be ventilated. With one end the air outlets are plugged into a blow-out hole which is part of the air duct extending underneath the floor. The negative and positive coupling elements may also include plugs and sockets for electric wires and telephone cables which run inside the tube portion. When the outlet tube is assembled from a plurality of tube portions each plug fits into the corresponding socket so that an outlet tube is obtained which does not only conduct the conditioned air but also includes the supply lines for the electric light and the telephone.

13 Claims, 25 Drawing Figures

Fig. 3
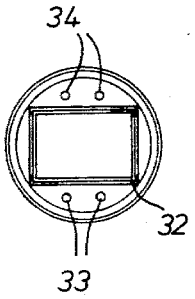
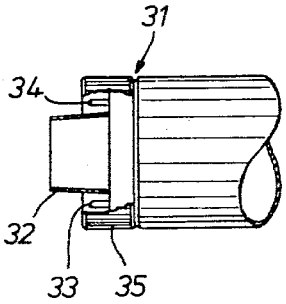
Fig. 4
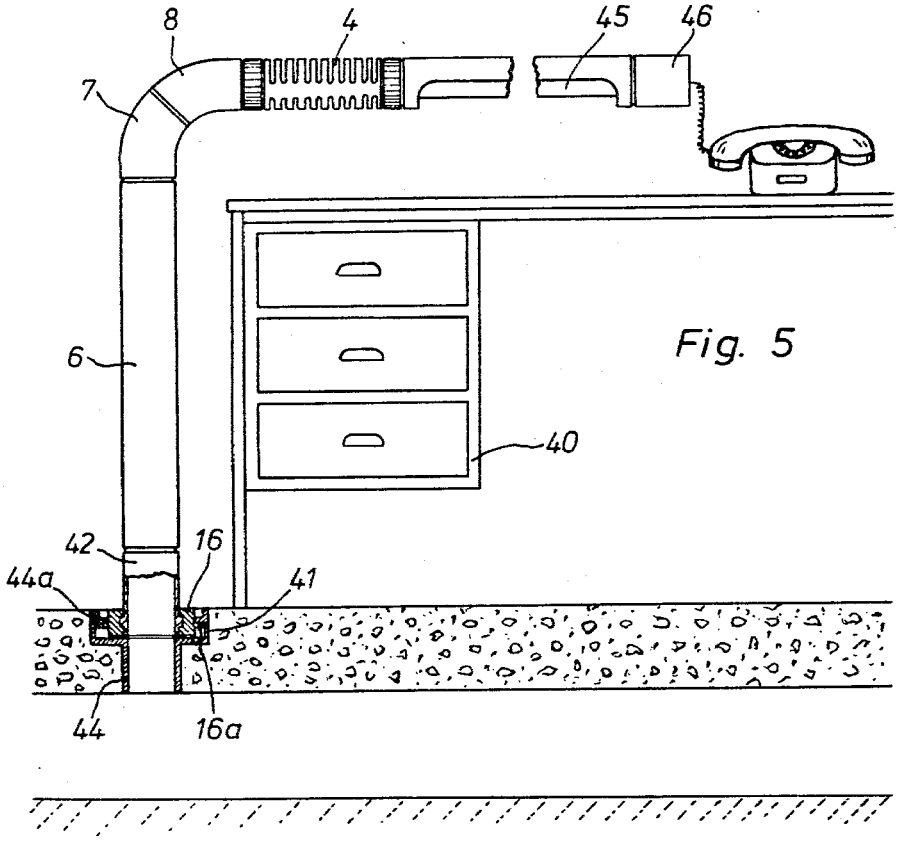
Fig. 5

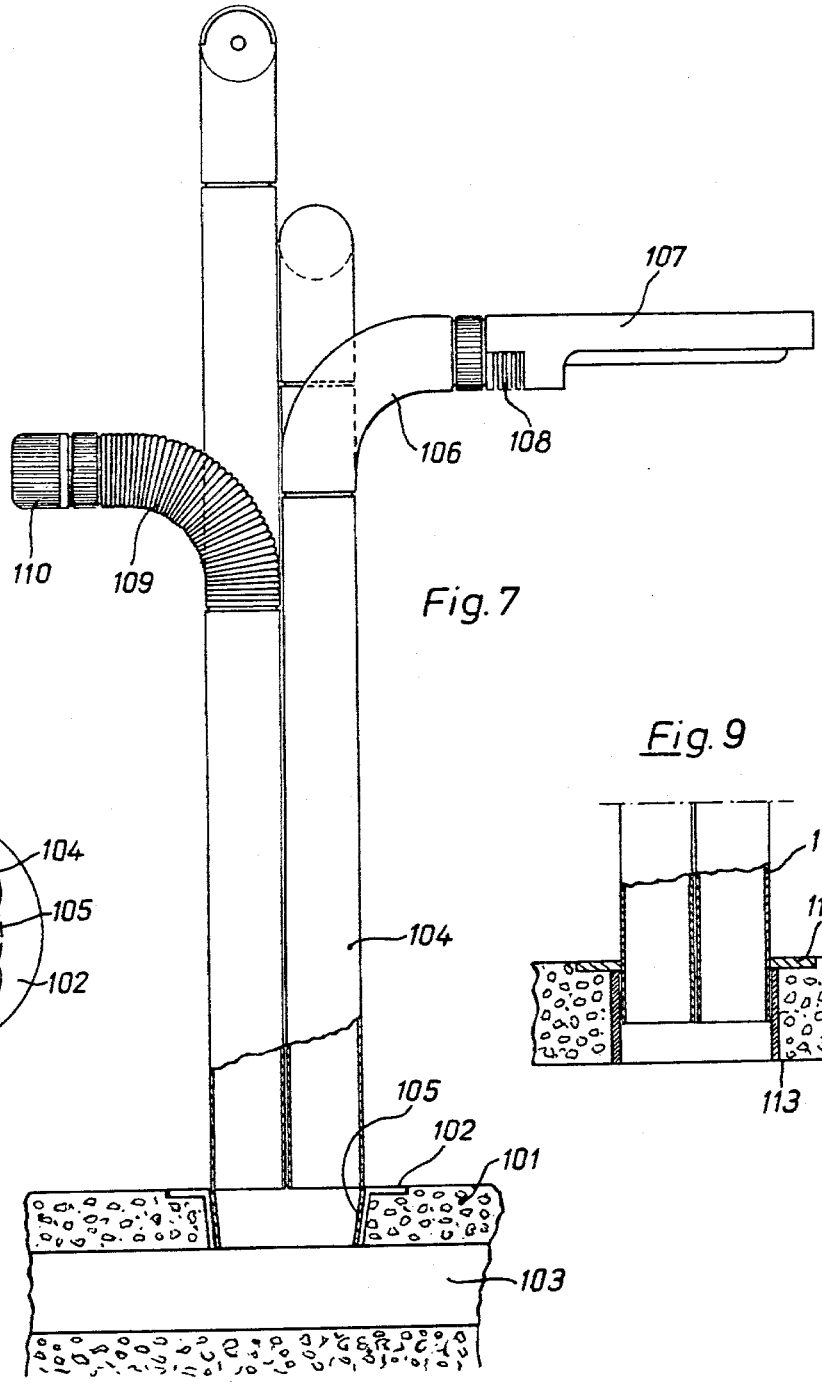
Fig. 7
Fig. 8
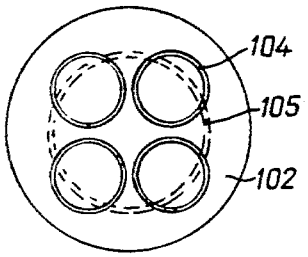
Fig. 9
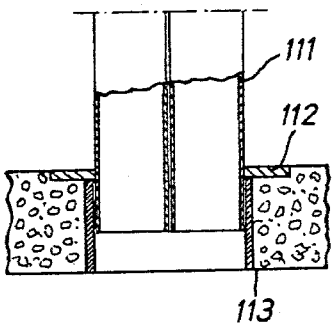

Fig.11
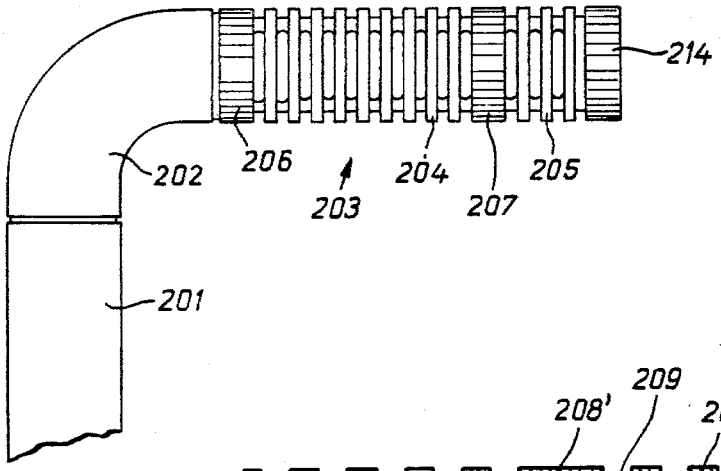
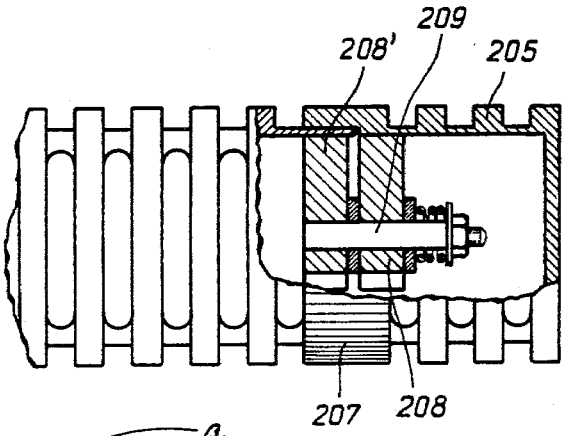
Fig.12
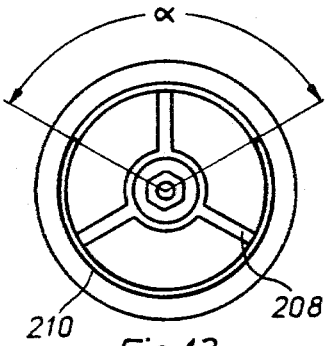
Fig.13
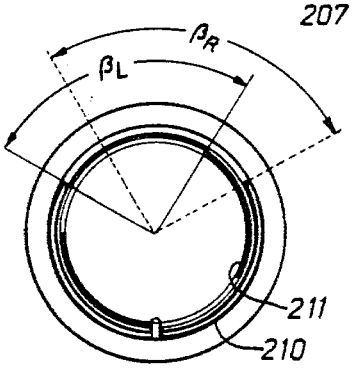
Fig.14
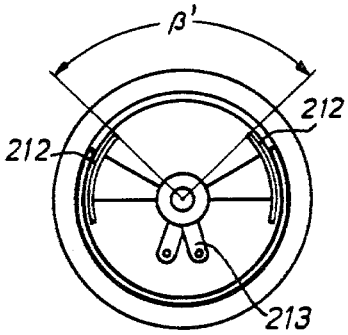
Fig.15

OUTLET TUBE FOR AIR CONDITIONING SYSTEMS

BACKGROUND OF THE INVENTION

The invention relates to the outlets of air conditioning systems, particularly of such systems which comprise air ducts extending underneath the floor and are provided with blow-out holes at different places. In prior art designs the air-dispersing front piece is usually connected to such a blow-out hole by a conduit which has coupling elements at its ends that fit in the blow-out hole and in the front piece. When not in use the blow-out holes in the floor are covered by a lid. The blow-out holes and the coupling elements of the conduit may also include in a structural unit the plugs and sockets for electric wires and telephone cables. Such combined elements are described, for example, in the German laid-open patent application DT-OS No. 24 07 448.

It is an object of the invention to provide outlet tubes of this type which can easily be adjusted to the specific requirements, for example to the height, prevailing at each working place, desk machine tool etc. to be supplied with conditioned air.

If more than one working place which are located close together are to be air conditioned it is in the present state of art necessary to connect the air-dispersing front pieces at each place to different blow-out holes, some of which may be located rather remotely. Such connections are usually accomplished by means of a conduit. It is a disadvantage, however, that the conduits have to lie on the floor where they present obstacles to walking, to the rolling of small cars etc.

It is, therefore, a further object of the invention to provide an air outlet which can supply various working places situated close together without making use of the impeding conduits.

It is an other object of the invention to improve the air-dispersing front pieces in such a way, that the man working at one particular desk, working place etc. may create his individual climate by adjusting the velocity, direction, shape of the air stream, and the air quantity, both of the cold and the heated air.

DESCRIPTION OF THE INVENTION

According to the invention the above stated objects are attained by an air outlet tube which is subdivided into a plurality of tube portions provided with corresponding air-tight coupling means at either end from which a complete outlet tube may be assembled that suits the specific requirements at each particular working place. The tube portions may be straight portions or elbow portions. The front portion may comprise the air-dispersing front piece and, for example, a lamp and/or a socket for plugging in an electrical appliance, or the telephone.

The tube portions may be rotatably connected with their coupling elements. For additional protection of the coupling between two tube portions a cap nut may be provided on one portion and a corresponding screw ring on the other. The supply cables, wires etc. are comprised in all tube portions which have matching plugs and sockets at both ends that come into engagement when an outlet tube is assembled from various portions.

For conducting conditioned air to different working places located close together it is suggested to mount two or more outlet tubes on one positive coupling element that fits into the blow-out hole in the floor. The different outlet tubes may be of different height and may be bent in different directions. The different tubes may be mounted separately in the coupling element, however, they may also end in one common tube so that only this common tube is attached to the coupling element. In this latter embodiment the distribution of the air into the different outlets occurs slightly above the floor where the different outlet tubes branch off from the common tube.

In an other embodiment a tube of normal cross section is connected to the positive coupling element which tube ends in a distributor armature. At least two outlet tubes are connected to this distributor. It is further possible to connect various distributor armatures in line so that a number of working places situated side by side may be supplied with fresh or heated air.

The distributor armatures may again comprise electric wires and telephone cables and the necessary plugs and sockets as described before.

It is further suggested to provide at the end of the outlet tube an air-dispersing front piece which is a hollow circular body having openings for the outgoing air. The front piece is rotatable and pivotable and can thus be pointed in any desired direction.

The openings may be closed by a cover which is adjustably arranged in front of them, inside of the hollow body. The cover may be adjustable in circumferential direction of the circular hollow body and may comprise of several portions. The portions are adjustable jointly or separately, in one common direction or in opposite directions. Thereby it is achieved that the size of the openings is limited either from one side alone or from the two opposite sides. Further, if the openings extends along the whole circumference it is possible to cover and uncover certain parts of the opening at random. Thus two openings of equal size (or of different size, if so chosen) may be formed which can be situated opposite to one another or at right angles to one another. All these combinations are possible and may serve to create an individual climate at any desk, working place etc.

A further possibility for creating an individual climate is obtained when the front piece is provided with two openings of different sizes arranged side by side in the direction of the axis of the front piece and by mounting a cover of the size of the smaller opening axially displaceable in front of said openings. Thereby the total air stream may be divided into a main stream, comprising for example between 70% and 100% of the total stream, and a partial stream, comprising for example between 30% and 0% of the total stream. The total air stream, i.e. the air quantity blown into the room, is independent from the cover adjustment and remains constant.

Since the two openings are jointly or separately rotatable about their axis the larger opening, conducting for example 80% of the total air quantity, may be directed away from the working place, desk etc. while the smaller opening, through which about 20% of the total air is blown, may be adjusted to point in the direction of the working place.

Such adjustments may also be made automatically by means of a feeler member, e.g. a thermostat.

BRIEF DESCRIPTION OF THE DRAWINGS

The invention will be more readily comprehended from the following description when taken in conjunction with the appending drawings, wherein:

FIG. 3 is a plan view of a coupling element, FIG. 4 is a side view of the coupling element shown in FIG. 3, FIG. 5 shows an assembled outlet tube with an air dispersing front piece and with connections for a lamp and a telephone extending above the desk, FIG. 7 is a side view of an air outlet comprising four different tubes, FIG. 8 is a sectional view of the air outlet shown in FIG. 7, cut horizontally in a plane close to the floor, FIG. 9 shows the outlet of FIG. 7 provided with a different coupling, FIG. 11 is a side view of an air-dispersing front piece having two openings of different size, FIG. 12 is a side view of a portion of the front piece shown in FIG. 11 on an enlarged scale, partially cut open, FIGS. 13–15 are cross sectional views of the front piece shown in FIG. 12 showing three different covers for the opening.

DESCRIPTION OF THE PREFERRED EMBODIMENTS

Figure 1:
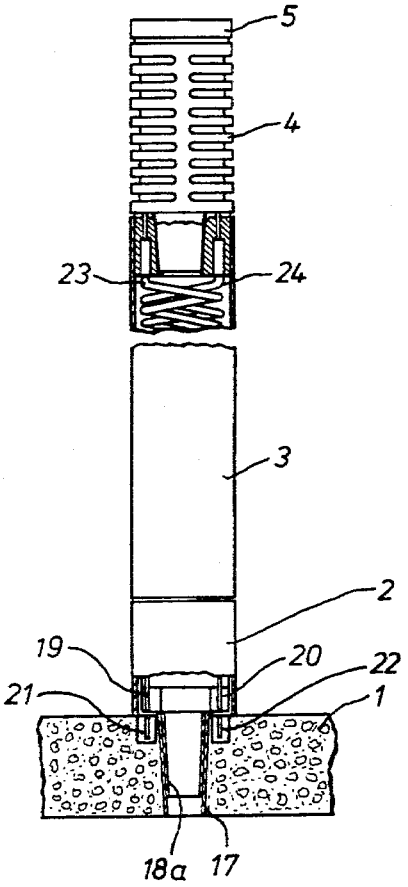
FIG. 1 shows an outlet tube assembled from three tube portions.

Referring now to the drawings, in FIG. 1 there is shown a conical blow-out hole 17 in the floor 1. The blow-out hole is provided with sockets 21 and 22 for telephone and power supply on opposite sides of the hole.

In this blow-out hole 17 there is inserted an outlet tube portion 2 which has a corresponding conical end 18*a* and plugs 19 and 20 which engage the sockets 21 and 22. The opposite end of the tube portion 2 has the same form as has the conical blow-out hole 17 so that a further tube portion 3 may be connected therewith. The conical negative coupling means at the end of this tube portion is in rotatable connection with this tube portion and, consequently, the cables 23 for the telephone connection and 24 for the power supply are wound in a screwlike manner in the interior of the tube portion. The tube portion 3 carries in its upper coupling means an air-dispersing front piece 4 of which the two ends are also provided with corresponding conical coupling means.

Figure 2:
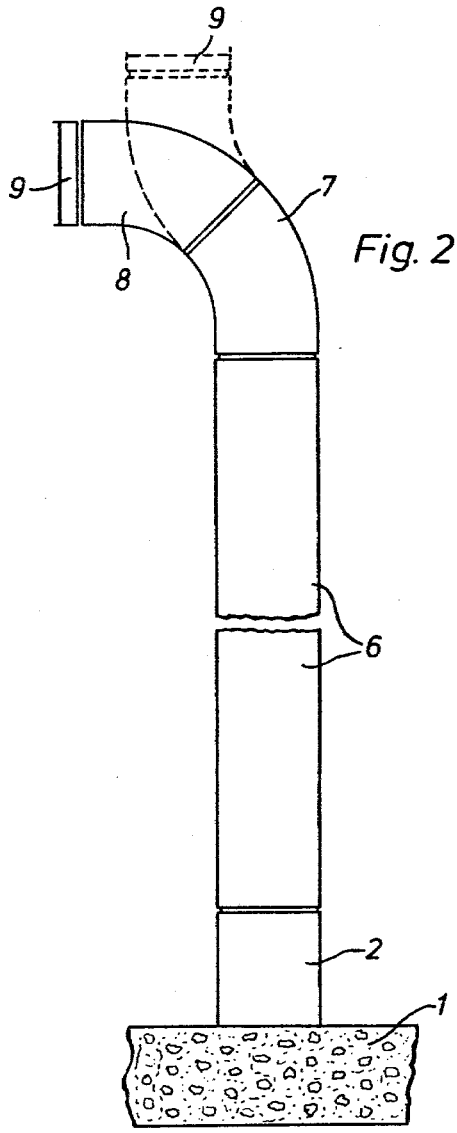
FIG. 2 shows an assembled outlet tube with rotatable elbow portion.
Figure 1A:
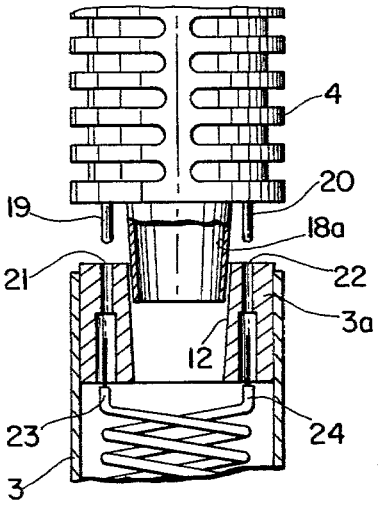
FIG. 1*a* shows in detail the rotating coupling portions of FIG. 1 in detail before coupling.
Figure 1B:
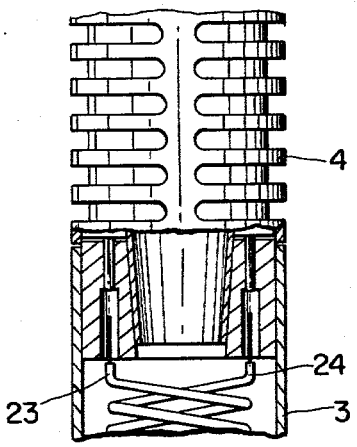
FIG. 1*b* shows the detail of FIG. 1*a* after coupling.

In the embodiment shown in FIG. 2 a tube portion 2 is inserted in the blow-out hole 17. A relatively long intermediate tube portion 6 is coupled to the tube portion 2 and an elbow tube portion is mounted on the tube portion 6. The elbow tube portion comprises of two sub-portions 7 and 8 which are rotatable relative to one another. The elbow portion carries an air-dispersing front piece 9.

Figure 4A:
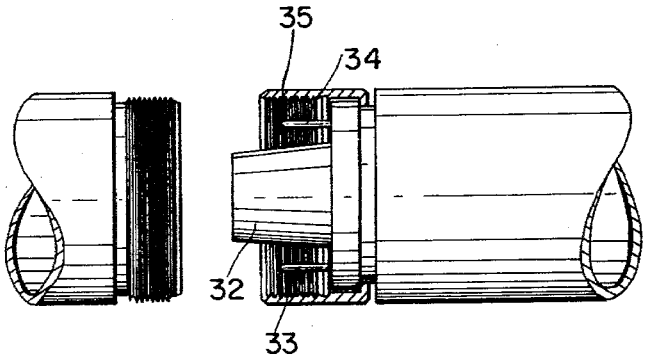
FIG. 4*a* shows both portions of the coupling element prior to coupling.

In the FIGS. 3 and 4 the coupling element 31 is shown to comprise a positive coupling means 32 and the plugs 33 and 34 for the telephone and the power supply. The coupling element 31 includes a rotatable cap nut 35 which engages a matching screw ring on the opposite coupling member (not shown). This screw connection renders additional protection to the coupling of two tube portions against pulling them apart unintentionally.

FIG. 5 shows a more complete assembly of tube portions extending over one side of a working desk 40. For connecting the tube 42 with the blow-out hole 44 in the floor a bayonet coupling is used which comprises a bayonet socket 44*a* that is port of the blow-out hole 44 and a bayonet ring 16 with bayonet tabs 16*a*. This ring is part of the tube portion 42. The other tube portions, e.g. the intermediate tube portion 6, the elbow portion 7;8, the air-dispersing front piece 4, the lamp 45, and the telephone connecting element 46 may also be mounted on the tube portions by means of bayonet couplings. However, there may also plug-in connections be used for this purpose as described with reference to FIG. 1.

Figure 6:
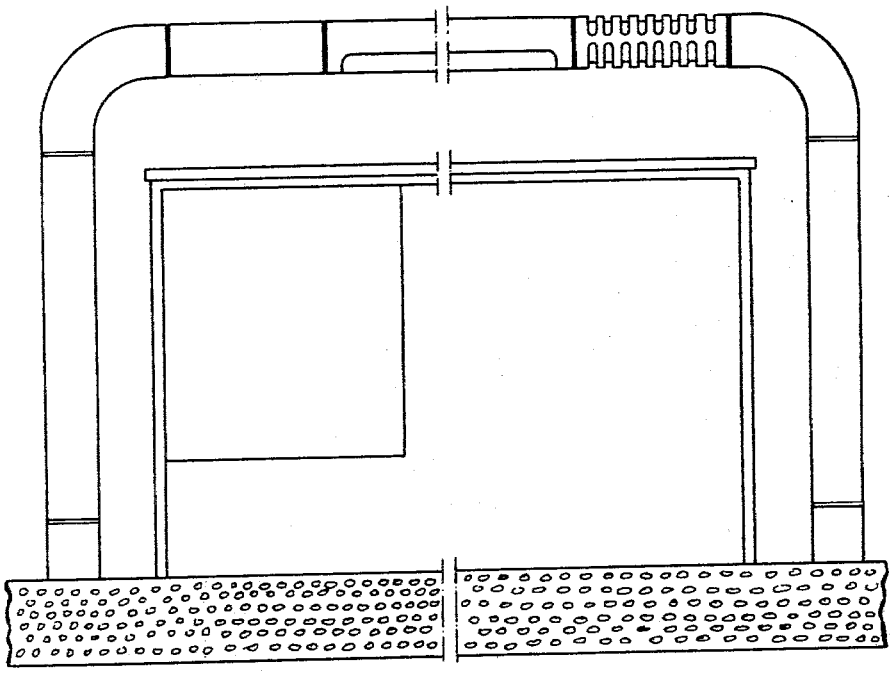
FIG. 6 shows two outlet tubes connected with one another and bridging a desk.

From the described tube portions, which may be complemented by additional specially equipped portions, various outlet tube combinations may be assembled differing from one another with regard to height and width so that the outlet tubes will meet any requirements that may be presented by the working places, desks etc. to be ventilated. Thus, it is, for example, possible to assemble a bridge over a desk or working place as shown in FIG. 6 which interconnects two blow-out holes in the floor. If so required it would even be possible to include a water pipeline in the outlet tube in order to supply cooling water to a machine tool.

Normally the outlet tubes are of circular cross section, however, they may also be of rectangular or elliptic shape.

In the FIGS. 7 and 8 there is shown a blow-out hole 102 in connection with an air duct 103 in the floor 101. The four air outlet tubes 104 are jointly mounted in a coupling plug 105 that fits into the blow-out hole 102. To the upper ends of the outlet tubes there are connected various armatures such as, for example, an elbow tube 106, a lamp 107 at the end of a short air-dispersing nozzle 108, and a flexible elbow tube portion 109 with an air-dispersing front piece 110.

FIG. 9 shows four outlet tubes 111 mounted air-tight in a disc 112 slightly above their lower ends. The disc covers the blow-out hole 113.

Figure 10:
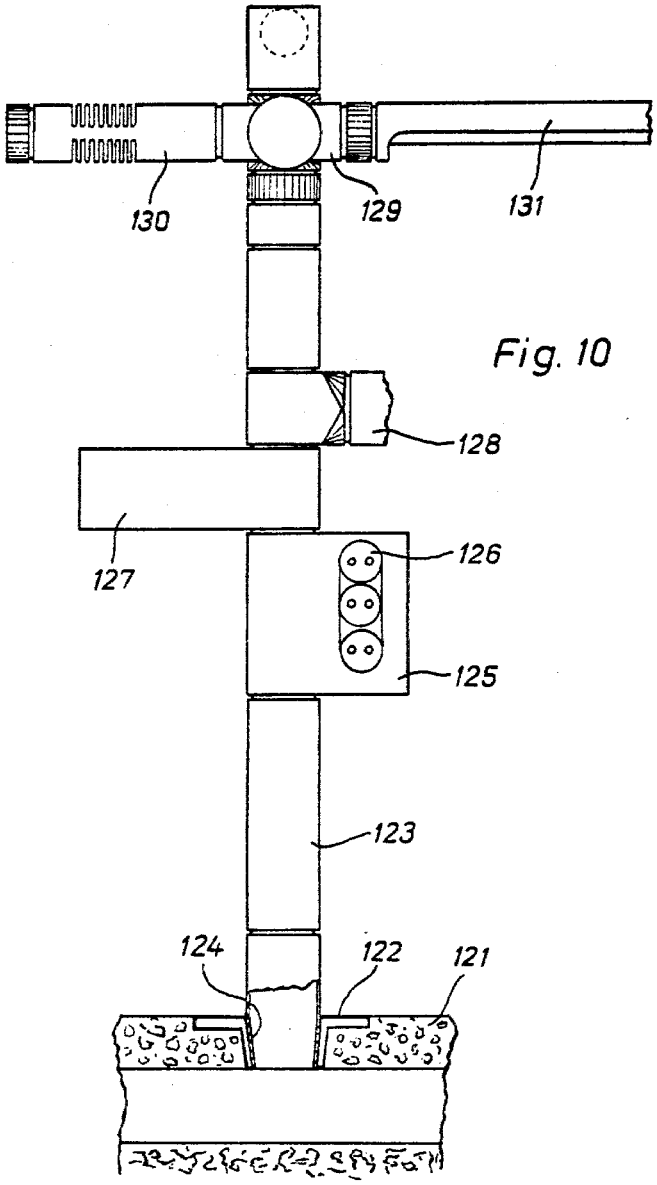
FIG. 10 is a side view of an air outlet assembled from a plurality of tube portions and comprising three distributor armatures.

In the embodiment shown in FIG. 10 the tube portion 123 is provided at its lower end with a conical coupling element 124 which is plugged into the corresponding coupling element 122 of the blow-out hole in the floor 121. By means of similar couplings there is connected an electrical armature 125 having sockets 126 to the upper end of the tube portion 124 and an air distributor 127 is connected to the top of the armature 125. A second distributor 128 is mounted on the first one and, in turn, a third distributor 129 is connected to said second distributor. The latter comprises on the left-hand side an air-dispersing element 130 and on the opposite side an electric lamp 131.

In the embodiment shown in the FIGS. 11 through 15 an air-dispersing element 203 is connected to the vertical tube portion 201 by means of an elbow 202. The element 203 is assembled from two armature portions 204 and 205. The portion 204 has a greater opening in axial direction and is rotatably mounted on the elbow 202 by means of a knurled ring 206. In like manner the armature portion 205 is rotatable relative to the portion 204 through a knurled ring 207. In order to make the armature portions 204 and 205 rotatable relative to one another both portions are provided with spokes 208 and 208' (FIG. 12). The hub of the spokes 208' carries a stud 209 on which the hub of the spokes 208 of portion 205 is hinged. A similar connection exists between the left-hand end of the portion 204 and the elbow 202.

The constant blowing angle in the cylinder wall 210 of both armature portions 204 and 205 is designated (FIG. 13). However, as shown in the FIGS. 14 and 15 this blowing angle may be varied and is then designated and respectively. To this end a cylinder cover 211 is rotatably disposed on the inner cylinder wall 210. By shifting this cover the angle may be adjusted to the blowing angle $_L$ or $_R$ respectively. In FIG. 15 a double-cover 212 is mounted in the cylinder. This double-cover can be opened and closed in a scissor-like manner. All covers can be adjusted by operating a knob 214 at the right-hand end of the armature portion 205.

In the FIGS. 16 through 20 it is illustrated that by using four covers 215 it is possible to form openings of different size which blow the air in different directions as indicated by the arrows in the drawings. All covers 215 may be provided with air guide plates (not shown).

Figure 21:
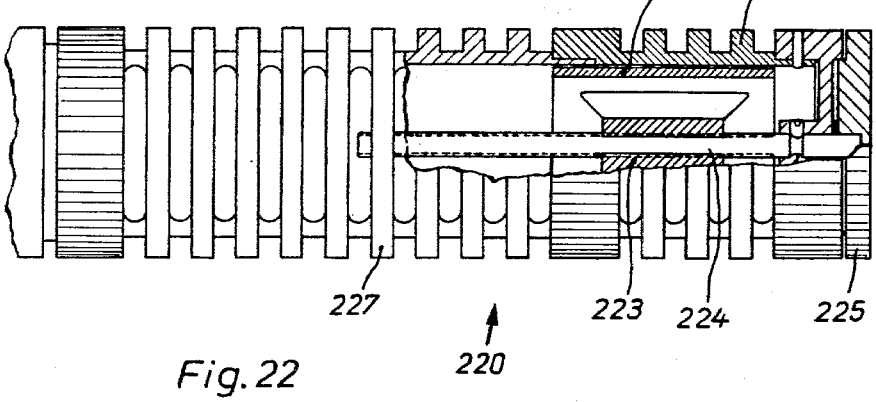
FIG. 21 shows an air-dispersing front piece having two openings of different size and an axially displaceable cover, partially cut open.
Figure 22:
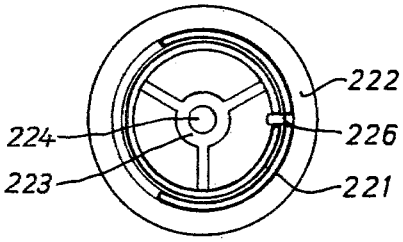
FIG. 22 is a cross sectional view cut through the front piece shown in FIG. 21.
Figure 16:
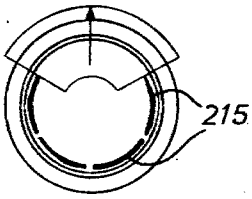
FIGS. 16–20 are cross sectional views of the front piece shown in FIG. 12 comprising a four-unit cover in five different positions.
Figure 17:
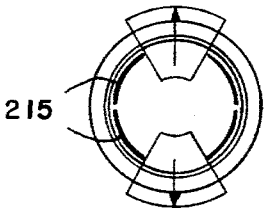
Figure 18:
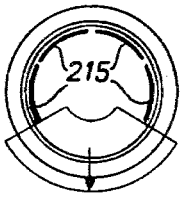
Figure 19:
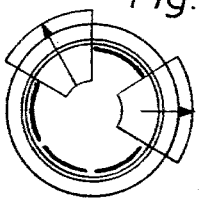
Figure 20:
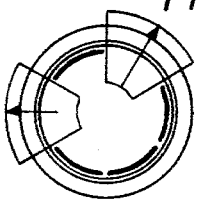

In the FIGS. 21 and 22 a cylindrical cover 221 is shown which is of the same length as the small air-dispersing element 222. The cover 221 is supported on a spindle 224 by means of a nut 223 which is fixedly connected with the cover 221.

On the right-hand side the spindle rests in a bearing formed by the element 222. When the knob 225 is turned the cover 221 is guided in linear direction by means of a pin 226 which moves in a groove. If it is desired to alter the ratio between the air stream emitting from the large and from the small air-dispersing elements 227;222—in FIG. 12 the small element 222 is completely shut off by the cover 221—the knob 225 must be turned so that the cover 221 is moved to the left-hand side on the spindle 224.

Further it is also possible to provide in the air-dispersing elements a combination of axially displaceable covers with covers which are adjustable in circumferential direction.

What is claimed is:

1. An outlet tube in combination with air conducting systems having an air duct extending underneath a room floor with a blow-out hole, said outlet tube and said blow-out hole having corresponding air-tight and detachable coupling members and being connected by said corresponding coupling members, said outlet tube comprised of a plurality of tube portions from which said outlet tube is assembled, and said tube portions being provided at their ends with said corresponding coupling members, said tube portions comprise electric wires and telephone cables ending in corresponding plugs and sockets which come into connection when said outlet tube is assembled from said tube portions, said tube portions comprising sub-portions which are rotatable relative to one another, said corresponding coupling members rotatably mounted on said tube portions, one of said tube portions comprising an electric lamp, and further comprising an air-dispersing element at the tube end, said air-dispersing element having openings and being provided with adjustable covers in front thereof.

2. An outlet tube as claimed in claim 1, and further comprising a cap nut (35) on one end of said tube portion (31) and a corresponding screw-ring on the opposite end of said tube portion.

3. An outlet tube as claimed in claim 1, wherein at least two tubes (104;111) are arranged parallel to one another for forming a structural unit.

4. An outlet tube as claimed in claim 3, wherein said tubes (111) are mounted separately on said coupling member.

5. An outlet tube as claimed in claim 3, wherein said tubes (104) are connected to one common tube portion (105) which is mounted on said coupling member.

6. An outlet tube as claimed in claim 1, wherein at least one of said tube portions (123) carries a distributor element (127;128;130) to which at least two additional armatures are connectable.

7. An outlet tube as claimed in claim 1, wherein said air-dispersing element is a hollow cylinder and said covers are disposed against the inner cylinder wall and are displaceable in circumferential direction.

8. An outlet tube as claimed in claim 7, wherein said cover is subdivided into a first cover portion (212) and a second cover portion (215) which are adjustable jointly or separately.

9. An outlet tube as claimed in claim 7, comprising openings along the total circumference of the cylinder wall and at least one circumferentially and/or axially displaceable cover against the inner cylinder wall for covering said openings.

10. An outlet tube as claimed in claim 1, wherein said cover is displaceable in axial direction.

11. An outlet tube as claimed in claim 1, wherein said cover is displaceable both in circumferential and in axial direction.

12. An outlet tube as claimed in claim 1, wherein said air-dispersing element comprises a first opening (227) and a second opening (222) arranged in line in axial direction, said first opening being larger than said second opening, and wherein a cover (221) is axially displaceable having substantially the length of said smaller opening.

13. An outlet tube as claimed in claim 1, wherein said outlet tube after said blow out-hole (102,113,122) is split at least in two tube portions (104,111;123,125,127, 128) of which the lowest portions are provided at their lower ends with corresponding coupling members (105,112,124).

* * * * *